United States Patent [19]

Gurzynska et al.

[11] 3,953,372

[45] Apr. 27, 1976

[54] PREPARATION OF EXTRINSIC SEMICONDUCTORS FOR ELECTRIC HEATING

[75] Inventors: Janina Gurzynska, Koszalin; Korneliusz Wesolowski, Warsaw, both of Poland

[73] Assignee: Huta Szkla im.Pablinskiego Przedsiebiorstwo Panstwowe, Wolomin, Poland

[22] Filed: June 13, 1973

[21] Appl. No.: 369,610

[30] Foreign Application Priority Data

June 17, 1972 Poland ..... 156060

[52] U.S. Cl. ..... 252/518; 427/87

[51] Int. Cl.[2] ..... H01B 1/06

[58] Field of Search ..... 252/518; 117/211, 212, 117/215, 229; 427/87

[56] References Cited

UNITED STATES PATENTS

| | | | |
|---|---|---|---|
| 2,687,395 | 8/1954 | Marks | 252/518 |
| 3,654,187 | 4/1972 | Takenaka | 252/518 |
| 3,669,907 | 6/1972 | Kohashi et al. | 252/518 |
| 3,692,573 | 9/1972 | Gurwood | 252/518 |
| 3,719,609 | 3/1973 | Topol | 252/518 |

*Primary Examiner*—Maynard R. Wilbur
*Assistant Examiner*—T. M. Blum
*Attorney, Agent, or Firm*—Eric P. Schellin

[57] ABSTRACT

The invention relates to a method of preparing extrinsic semiconductors, useful for electric heating, comprising the step of putting onto a glass, ceramic, etc., surface a transparent semiconductive heating coating of low stable resistance, which is tolerant to high electric loading.

As the basic substance of the conductive coatings chemical compounds in which the cation has variable valence, for instance halides or oxides of tin, bismuth or niobium, are used.

To the basic substance a thermo-electric buffer is added. This substance supplies a characteristic enabling regulation of conduction in the coating as a function of temperature, as a result of the existence of excess current carriers. At lower temperatures these carriers enlarge the conduction, and at higher temperatures, they diminish the conduction.

For use as a thermo-electric buffer, such chemical compounds must have a cation which has an ion radius smaller by at least 20 per cent than that of the cation of the basic substance, for instance: oxides, halides, carbides, carbonates. In the case of electron type conduction in the extrinsic semiconductor, a buffer compound, in which the cation has a valence lower than that of the basic substance cation maximal valence, is used. In the case of hole type conduction, a buffer compound in which the cation has a valence higher than that of the basic substance cation valence, is used.

The prepared extrinsic semiconductor is put onto a heated surface in two layers. First, the basic substance is applied and next the mixture of thermo-electric buffer and the basic substance is applied.

3 Claims, No Drawings

PREPARATION OF EXTRINSIC SEMICONDUCTORS FOR ELECTRIC HEATING

This invention relates to the method of preparation of extrinsic semiconductors, for electric heating. The semiconductors are transparent semiconduction heating layers of stable low resistance, tolerant to high electric loading and have a transparency higher than 80 per cent.

According to known methods of producing the extrinsic semiconductors, salts or metal oxides are used in which the cation is capable of changing its valence. Salts or oxides of those metals in pure state usually have high resistance and, in fact, they are insulators. To make them current carriers it is necessary to disturb the stoichiometric balance of the compound. Such a phenomenon is carried out under the influence of either temperature or surrounding atmosphere or as the result of introducing an admixture of cation of different valence.

When partial and time-variable non-proportionality in ions of various valence occurs, the result is that the material becomes a good conductor of current, because conditions are created for creating of free current carriers either of electron type or of hole type. The prior art is not capable of creating conditions such that the state of departure from stoichiometry is constant as a function of temperature and time. This results from the fact that in the role of conduction regulators only admixtures of transistory metal compounds of variable valence are used, which however cause the increase of the quantity of produced current carriers of thermal origin but which cannot be regulated. At low temperatures conduction is increased to some extent, but not sufficiently, and at high temperatures conduction is increased more rapidly with increase of temperature.

The known methods of manufacture of heating layers do not produce stable heating layers and particularly do not achieve a resistance lower than 40 Ohms-per-square, while simultaneously preserving high transparency and stability of those layers under the influence of heating. That is, heating layers made according to known methods of production are not tolerant to high electric power loading.

The object of the invention is to introduce into the substantial extrinsic semiconductors, namely, the basic material, some thermo-electric buffer material whose properties enable regulation of electric conduction as a function of temperature, thus stabilizing the properties and enlarging durability of the produced heating layers. Thermo-electric buffers supply redundant current carriers which increase conduction at lower temperatures and diminish it at higher temperatures. They play a role similar to that of buffer substances in electrolysis.

The object was obtained by adding to the basic material, or to the basic material with admixtures, a chemical compound such as a thermo-electric buffer, whose cation has an ion radius at least 20 per cent smaller than the cation of the basic material with or without the admixture, and simultaneously those cations should have ion radiuses of similar size for mutual interchange in the crystal lattice, so as to create a stable condition and, in result, to buffer the state of electric conduction.

As the result of its small radius, the cation of the thermo-electric buffer does not match the dimensions of the crystal lattice cell, and it does not occupy the corners of the crystal lattice, but occupies space inside the crystallographic cell, and because of this it acts as an admixture diminishing the energy level of the current carriers, increasing the conduction. At higher temperatures the energetic conditions let it occupy places in unoccupied crystal lattice nodes, which results in the creation of reversed current carriers. Partial recombination occurs and the quantity of current carriers is decreased, returning to the original state.

The admixtures themselves as well as buffer substances act properly only in cases where they are introduced by mixing and mutual melting or melting and disintegrating, after which the mixture is heated up to a temperature near the melting temperature of the mixture several times, and then intensively crushed with simultaneous rapid cooling. Uniform and active mixing of buffer admixtures in the basic material is achieved by this procedure. Prepared in such a way, a mixture will produce conductive coatings with resistance of only one Ohm-per-square which are tolerant to power loading higher than 20 watt/cm$^2$.

Preparation and activation of an extrinsic semiconductor with a thermo-electric buffer is carried out by the initial mixing of a composition followed either by initial melting or dissolution in a solvent or by dispersion in a diluent such as water, alcohols, acids and esters. After accurate mixing of the solution or dispersion, the liquid is evaporated or distilled off and the residue is thermally activated by repeated melting procedures, followed by rapid cooling with simultaneous intensive crushing. As the basic substance, many chemical compounds can be used, provided that their cations have a variable valence. For instance: halides, oxides, metal-organic compounds, indium, cadmium, niobium, vanadium, tin, bismuth and uranium carbonates.

As a thermo-electric buffer, a chemical compound is used in which the cation has an ion radius at least 20 per cent smaller than the radius of the cation of the basic material.

For electron type conduction, chemical compounds are used in which the cation valence is lower than the basic semiconductor cation maximal valence and for the hole type conduction, chemical compounds are used in which the cation valence is higher than the basic semiconductor cation valence.

The most advantageous for usage are compounds such as: oxides, halides, metal-organic compounds - carbides and carbonates.

Extrinsic semiconductors prepared according to the invention can be put onto the surface of glass, porcelain and similar materials by way of coating, sublimation or electrostatic dusting. Two layers of semiconductor should be applied: a first layer without admixture and a second one with admixtures and thermo-electric buffer. Vertical polarization arising in those two layers is advantageous for the stabilization and durability of heating elements. The layers are melted into the heated surface of a thermally resistant substrate material and they create a transparent mono-molecular surface conductive layer. This property of preservation of transparency, at a small and stable electrical layer resistance, creates great possibilities for applications in glass and quartz chemical heating apparatus, glass heating in cars, planes and ships as well as in a wide range of household devices for heating, such as dryers, refrigerator heaters and for house heating. The use of a semiconductive layer according to the invention on other thermally resistant bases such as porcelain, enamels or metals covered with oxides, creates a whole range of new applications useful in technics and household.

The method according to the invention is better explained in the example which follows, which illustrates but in no extent limits the invention:

Ground Coat (Basic mixture composition used as ground coat.)

| | | |
|---|---|---|
| Hydrated stannic chloride | — | 150 weight parts |
| Antimony trichloride | — | 10 weight parts |
| Ammonium fluoride | — | 2 weight parts |

Top Coat (Composition of mixture with admixtures and buffer.)

| | | |
|---|---|---|
| Hydrated stannic chloride | — | 120 weight parts |
| Antimony trichloride | — | 9 weight parts |
| Ammonium flouride | — | 2 weight parts |
| Cuprous oxide | — | 2 weight parts |
| Boric acid | — | 1 weight part |
| Cadmium chloride | — | 1 weight part |

Each of the mixtures are separately melted and then accurately comminuted with simultaneous cooling. The comminuted mixtures are then applied by coating, sublimation or dusting onto the surface of glass products which have been heated to a temperature relatively close to the glass annealing temperature range. First a basic layer should be applied, using the ground coat mixture, as in the example, and then the second layer with admixtures and buffer should be applied over the first one, using the top coat mixture, as in the example.

We claim:

1. The method of preparing a composition, for use as a transparent resistive coating on an insulating substrate, in which the coating can withstand a power loading of 20 watts per square centimeter, said method comprising:

combining a major coating component, comprised of stannic chloride, antimony trichloride and ammonium fluoride;

combining a minor thermoelectric buffer component, comprised of cupreous oxide, boric acid and cadmium chloride;

separately melting each of the resulting components;

intimately mixing the two melts;

freezing the resulting composition;

crushing the resulting frozen composition;

remelting the crushed composition;

refreezing the remelted composition; and recrushing the thus processed composition.

2. The method of claim 1 in which the last three steps of remelting, refreezing, and recrushing are repeated, seriatim, an integral number of times.

3. The method of claim 1 in combination with the further step of coating said insulating substrate with the crushed composition produced.

* * * * *

UNITED STATES PATENT AND TRADEMARK OFFICE

CERTIFICATE OF CORRECTION

PATENT NO. : 3,953,372
DATED : April 27, 1976
INVENTOR(S) : Janina Gurzynska and Korneliusz Wesolowski It is certified that error appears in the above-identified patent and that said Letters Patent are hereby corrected as shown below:

In the heading of the patent, line 7, change "Pablinskiego" to --Paplinskiego--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*